US007172089B2

(12) United States Patent
Erich

(10) Patent No.: US 7,172,089 B2
(45) Date of Patent: Feb. 6, 2007

(54) MOTOR VEHICLE

(75) Inventor: Bernd Erich, Waiblingen (DE)

(73) Assignee: Dr. Ing. h.c.F. Porsche Aktiengesellschaft, Stuttgart (DE)

( * ) Notice: Subject to any disclaimer, the term of this patent is extended or adjusted under 35 U.S.C. 154(b) by 0 days.

(21) Appl. No.: 11/012,241

(22) Filed: Dec. 16, 2004

(65) Prior Publication Data

US 2005/0133112 A1 Jun. 23, 2005

(30) Foreign Application Priority Data

Dec. 19, 2003 (DE) ..... 103 59 767

(51) Int. Cl.
*B65D 51/16* (2006.01)

(52) U.S. Cl. ..... 220/203.06; 220/203.04; 220/203.05; 220/360

(58) Field of Classification Search ..... 220/203.06, 220/203.26, 203.01, 203.04, 203.05, 203.24, 220/203.25, 203.28, 360, DIG. 32, 203.07, 220/203.27, 203.29; 180/68.4
See application file for complete search history.

(56) References Cited

U.S. PATENT DOCUMENTS 1,685,918 A * 10/1928 Karmazin ..... 220/304
3,062,400 A * 11/1962 Humbert ..... 220/203.26
3,071,285 A * 1/1963 Friend ..... 220/203.18
3,910,451 A * 10/1975 Tusing ..... 220/203.26
4,079,855 A * 3/1978 Avrea ..... 220/203.26
4,185,751 A * 1/1980 Moore et al. ..... 220/203.26
5,071,020 A * 12/1991 Reutter ..... 220/203.06
5,248,052 A * 9/1993 Mellinger et al. ..... 220/202
5,522,456 A * 6/1996 Valk ..... 165/104.32
5,603,425 A * 2/1997 Breeden ..... 220/203.06
6,276,312 B1 * 8/2001 Summan et al. ..... 123/41.54
6,324,759 B1 * 12/2001 Sasano et al. ..... 29/890.03
6,378,717 B1 * 4/2002 Reutter ..... 220/201
6,390,318 B1 * 5/2002 Tanaka et al. ..... 220/203.26
6,435,367 B1 * 8/2002 Reutter ..... 220/203.07
6,729,271 B1 * 5/2004 Reutter ..... 123/41.54

FOREIGN PATENT DOCUMENTS

DE 10033953 2/2001

* cited by examiner

*Primary Examiner*—J Allen Shriver
(74) *Attorney, Agent, or Firm*—Crowell & Moring LLP

(57) ABSTRACT

In a motor vehicle having a chassis, an engine cooled with fluid via a coolant system and a filling connection for the coolant system, the filling connection is equipped with a filling opening, a removable closing cap for the filling opening and an overflow connection with a drain opening at one end, with the overflow being opened on removal of the closing cap. The filling opening of the filling connection is situated on a first side of a chassis wall, and the overflow connection with its outlet opening opens on the second side of the wall, i.e., on the side opposite the first side.

21 Claims, 2 Drawing Sheets

MOTOR VEHICLE

BACKGROUND OF THE INVENTION

This application claims the priority of DE 10359767.022, filed Dec. 19, 2003, the disclosure of which is expressly incorporated by reference herein.

The present invention relates to a motor vehicle having a chassis, an engine that is cooled with fluid through a coolant system and a filling connection for the coolant system. The filling connection is equipped with a filling opening, a removable closing cap for the filling opening and an overflow connection with an outlet opening at one end, with the overflow being openable when the closing cap is removed.

A motor vehicle of the general type having a filling connection for a coolant system is described, for example, in U.S. Pat. No. 5,603,425A. The filling connection has a filling opening for the fluid and a removable closing cap for the filling opening. To prevent fluid from splashing out of the filling connection uncontrollably on removing the closing cap when the liquid contents are hot and under pressure, the filling connection is provided with an overflow connection which is opened just before the closing cap is completely removed to thereby dissipate the excess pressure of the liquid coolant through this overflow connection. The overflow connection is directed away from the filling connection and may be connected to a tube so that fluid escaping through the overflow connection is able to flow away from the filling connection.

A similar design of a filling connection with a filling opening, a closing cap and an overflow connection is also shown in DE 100 33 953 A1.

SUMMARY OF THE INVENTION

An object of the present invention is to provide in a motor vehicle improved protection for a person removing the closing cap when there is hot fluid in the coolant system.

This object has been achieved with a motor vehicle by providing that the filling opening of the filling connection is situated on a first side of a wall of the chassis, and the overflow connection with its outlet opening opens on another side of the wall opposite the first side.

Among the main advantages achieved with this invention is that a barrier is created by the wall itself due to the arrangement of the filling opening of the filling connection opposite the outlet opening of the overflow connection on a wall of the chassis, which at least reduces the risk of unintentional contact with the hot liquid escaping from the overflow connection for a person removing the closing cap from the filling connection.

When the closing cap is removed, the overflow connection is already opened by the cutoff before the closing cap has been removed completely. Thereby, any excess pressure in the coolant system cannot be dissipated through the filling opening but instead must be dissipated through the overflow connection.

The opening and/or closing of the overflow connection can also be achieved simply. Moreover, it is advantageous that when refilling the coolant system with fluid, any fluid that might be spilled can be collected, and thus the surrounding vehicle parts, e.g., trim panel parts, are protected. Also, liquid that enters the drip pan can be drained out through a drain connection.

A currently preferred embodiment is characterized by ease of manufacturing. The filling connection, the overflow connection and the drip pan are aligned in relation to one another so that they can be unmolded jointly from the injection mold when manufactured in one piece, e.g., by injection molding of plastic.

Refilling of the fluid may also be permitted without having access to the engine compartment. This is advantageous in particular with vehicles in which the engine is not directly accessible, as is the case, for example, with motor vehicles having a central engine arrangement.

The interior of the vehicle can be designed to be continuous and includes the passenger compartment and the baggage compartment, as is provided in particular in a passenger vehicle having a body in the form of a coupe with a central engine.

Other objects, advantages and novel features of the present invention will become apparent from the following detailed description of the invention when considered in conjunction with the accompanying drawings.

DETAILED DESCRIPTION OF THE DRAWINGS

Figure 1:
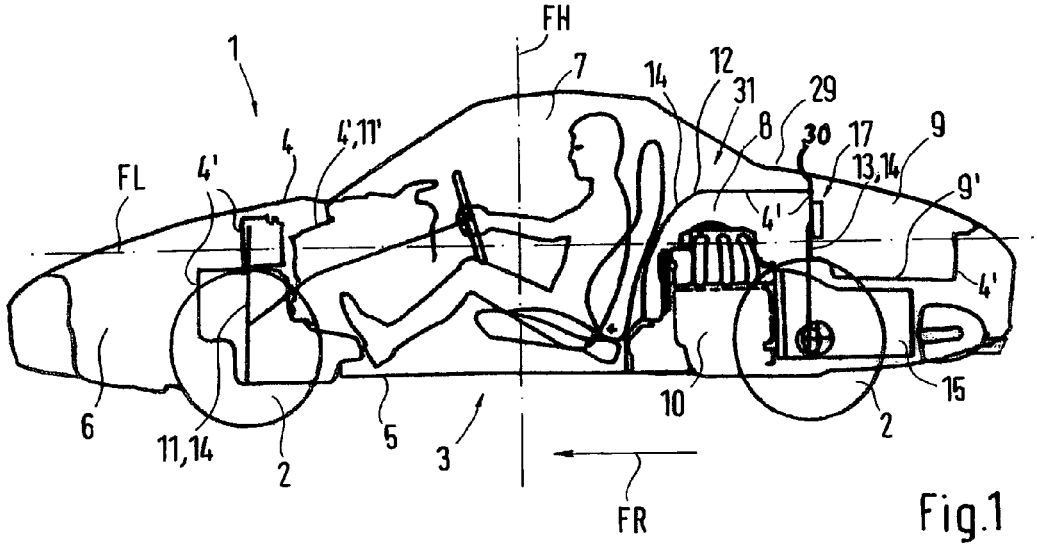
FIG. 1 is a schematic cut-away side view of a passenger motor vehicle.

The vehicle 1, particularly a passenger car, which is shown in FIG. 1 in cross section parallel to the longitudinal axis FR of the vehicle has a body 3 supported by wheels 2 with a chassis 4 which sits on a bottom group 5 of the body 3 and includes several walls 4'. The walls 4' border multiple vehicle compartments 6, 7, 8 and 9. The engine 10 of the vehicle 1, in particular an internal combustion engine, is accommodated in one of the vehicle compartments 6, 8, 9, i.e., the engine compartment. In the illustrated embodiment, the engine 10 is arranged in a so-called central engine arrangement in the vehicle compartment 8 of the motor vehicle 1, with the vehicle compartments 6 and 9 forming a rear and a front baggage compartment, respectively. However, it is also contemplated for the engine 10 to be provided in the front vehicle compartment 6 or in the rear vehicle compartment 9, i.e., as a front engine or a rear engine, respectively.

The individual vehicle compartments 6, 7, 8 and 9 are surrounded by the walls 4', some of which are provided as partitions 11, 12 and 13 and divide two vehicle compartments 6, 7, 8, 9 from one another. The partition 11 is situated in front of an end wall and/or a splash wall 11' and is arranged with it between the vehicle compartments 6 and 7. The splash wall 11' may form another partition. The partitions 11', 11, 12 and 13 are essentially upright and have at least one wall section 14 which is also essentially upright, i.e., running approximately in the direction of the vertical axis of the vehicle FR.

A transmission unit 15 is also flange-connected to the engine 10; in the illustrated embodiment, the transmission unit is situated behind the engine 10 (as seen in the travel direction FR) and in the embodiment shown here it is situated beneath the floor 9' of the vehicle compartment 9. The engine 10 is cooled with fluid and therefore includes a coolant system, which is not shown in detail here, only a filling connection 16 thereof being shown in FIGS. 2, 3 and 4. The filling connection 16 here is provided with a service unit 17 which is arranged in one of the vehicle compartments 6, 8 or 9 on one of the walls 4', in particular one of the partitions 11, 12 or 13. In the illustrated embodiment, this wall is the partition 13 of the vehicle compartments 8, 9. For example the service unit 17 includes in addition to the filling connection 16, an oil filling connection 18 which is sealed with a cover 19.

Figure 2:
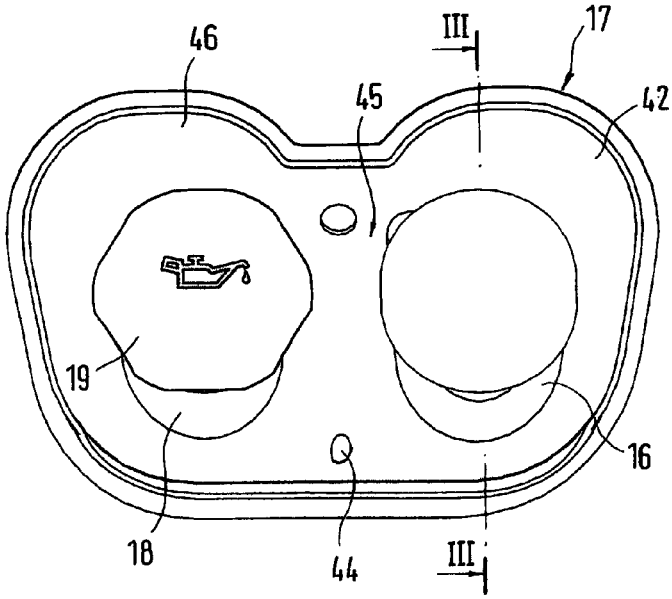
FIG. 2 is a plan view of the details of a service unit having a filling connection for a coolant system for the engine of a motor vehicle.

In a first embodiment of the service unit 17, the filling connection 16 is explained in greater detail below with respect to FIG. 3, with the same part or parts having the same effect as in FIG. 1 and FIG. 2 being provided with the same reference numerals. The filling connection 16 includes a filling opening 20 which is in the vehicle compartment 9 and is configured on a free end of the filling section 21 of the filling connection 16. The filling section 21 develops or transitions into a connecting section 22 which runs at an angle to the former and is connected to the coolant system (not shown) of the engine 10.

An overflow connection 24 runs from the filling connection 16 with its pipe wall 23 and is close to the filling opening 20 and the filling section 21. The overflow connection 24 is formed by a tubular projection which emanates from the side of the filling connection 16 and has an inlet opening 25 in the pipe wall 23. The connection 24 runs approximately parallel to the connecting section 22 of the filling connection 16. Opposite the inlet opening 25 on the other end thereof, the overflow connection 24 opens into the vehicle compartment 8 adjacent to the vehicle compartment 9 so that the filling opening 20 tends to lie on a first side 26 with respect to the partition 13 and an outlet opening 27 of the overflow connection 24 which is on the end and opposite the inlet opening 25 comes to lie on the second side 28 of the partition 13 opposite the first side 26. In other words, the filling opening 20 is in a different vehicle compartment 6, 7, 8, 9 than the outlet opening 27 of the overflow connection 24. In the illustrated embodiment, the vehicle compartment 9 is thus on the first side 26 of the partition 13 and the vehicle compartment 8 is on the second side 28 of the partition 13.

FIG. 1 shows a sheet metal web 30 between the vehicle outer skin 29 and the upright partition 13, dividing the vehicle compartment 9 and the vehicle compartment 7, but this could also be omitted so that the vehicle compartment 7, which is also referred to as the passenger compartment, and the vehicle compartment 9, which is also to be used as the baggage compartment, form a continuous vehicle interior 31.

Figure 3:
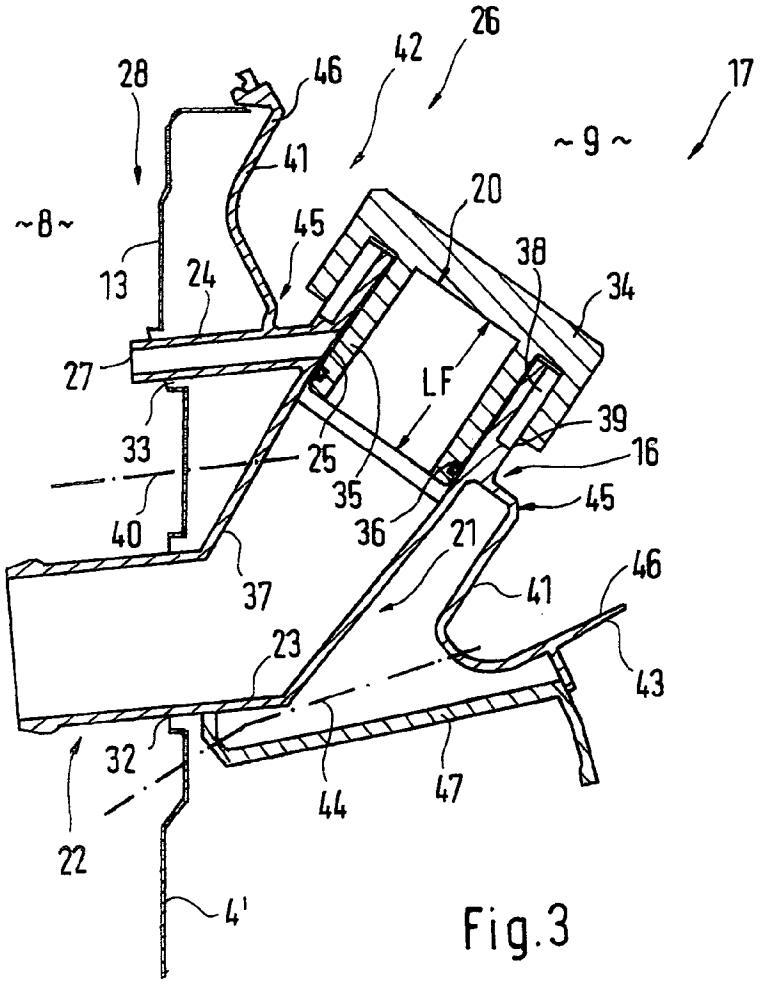
FIG. 3 is a detailed sectional view along line III—III in FIG. 2 illustrating the filling connection with a closing cap and an overflow connection according to a first embodiment of the service unit according to the present invention.

As shown further in FIG. 3, the filling connection 16 with its connecting section 22 passes through the partition 13 in a passage 32. Similarly, the overflow connection 24 leading away from the filling connection 16 after the filling opening 20 also passes through the partition 13 in another passage 33. Furthermore, FIG. 3 shows a sealing cap 34 for the filling connection 16 to seal the filling opening 20 tightly, to which end a gasket 36 which cooperates with the inside 37 of the pipe wall 23 is provided on the outside of an internal extension 35, e.g., a tubular extension. The length LF of the extension 35 is of such dimensions that it forms a cutoff for the overflow connection 24 together with the gasket 36. The extension 35 seals the overflow connection 24 with its inlet opening 25 at a distance from the sealing opening 20 when the sealing cap 34 is completely placed on the filling connection.

To fasten the sealing cap 34 on the filling connection 16, an appropriate safety lock 38 may be provided between the section of the sealing cap 34 which extends over the filling connection 16 and the outside 39 of the pipe wall 23. Such lock 38 may be configured in particular as a screw closure or a bayonet closure. When the closing cap 34 is removed from the filling connection 16, the extension 35 thus opens the inlet opening 25, so that the hot fluid which might be under pressure in the coolant system is able to flow into the overflow connection 24 and be guided through it away from the filling connection 16 to the second side 28 of the partition 13 where it can be drained, for example, into the engine compartment which is open at the bottom. It is also contemplated, however, to provide an extension, e.g., in the form of a hose or the like on the outlet opening 27 of the overflow connection 24. Thus when removing the closing cap 34, excess pressure within the coolant system can be dissipated through the overflow connection 24 so that no liquid coolant escapes from the filling opening 20. Only after completely removing the closing cap 34 when the excess pressure has dissipated can the coolant system be filled through the filling connection 16. FIG. 3 shows schematically with dash-dot lines 40 another connection which can pass through the partition 13 to be connected to an equalizing tank of the coolant system, if one is provided, and the filling connection 16.

A collar 41 which at least partially surrounds the filling connection 16 is configured as a drip pan 42 around the filling opening 20 and/or the outside 30 of the pipe wall 23 of the filling connection 16 so that when fluid is added to the coolant system, any fluid that is spilled is collected so that it does not enter the vehicle compartment 6, 7, 8 and/or 9 into which the filling connection 16 protrudes. The drip pan 42 is set back at a distance from the filling opening 20 in the direction of the connecting section 22, thereby covering the overflow connection 24 and also protruding beyond the filling opening 20 with its lower collar section 43 beneath it.

To be able to drain off fluid collected in the drip pan 42, according to FIG. 3, a drain connection 44 (indicated schematically with dash-dot lines) is provided in the area of the lower collar section 43, passing in particular through the partition 13 and thus conveying the fluid into the compartment 8, i.e., opening into the compartment 8 on the second side 28. The drip pan 42 and drain connection 44 are preferably one piece.

In a currently preferred embodiment, the filling connection 16, the overflow connection 24 and the drip pan 42 are one piece, e.g., an injection-molded plastic part. In order to be able to remove the finished one-piece part consisting of the filling connection 16, the overflow connection 24 and preferably the drip pan 42 from the injection mold, the connecting section 22 and the filling section 21 run at an angle to one another and the overflow connection, which leads away from the filling section 21 runs approximately parallel to the connecting section 22.

In addition, the drip pan 42 with its shell wall, i.e., the collar 41, runs in the direction of the filling opening 20 so that the shell bottom 45 is adjacent to the pipe wall 23 of the filling connection 16 and the peripheral wall 46 of the shell extends from the shell bottom 45 essentially into the vehicle compartment 9, where the drip pan 42 could be fabricated in one piece with the filling connection 16 and the overflow connection 24, if necessary. The drain connection 44 and the connecting connection 40 may be one piece with the filling connection 16, if necessary. The drip pan 42 can be inserted into a trim panel part 47 which lines the partition 13 and/or the vehicle compartment 9 and may be designed as a molded part and/or as a trim panel.

Figure 4:
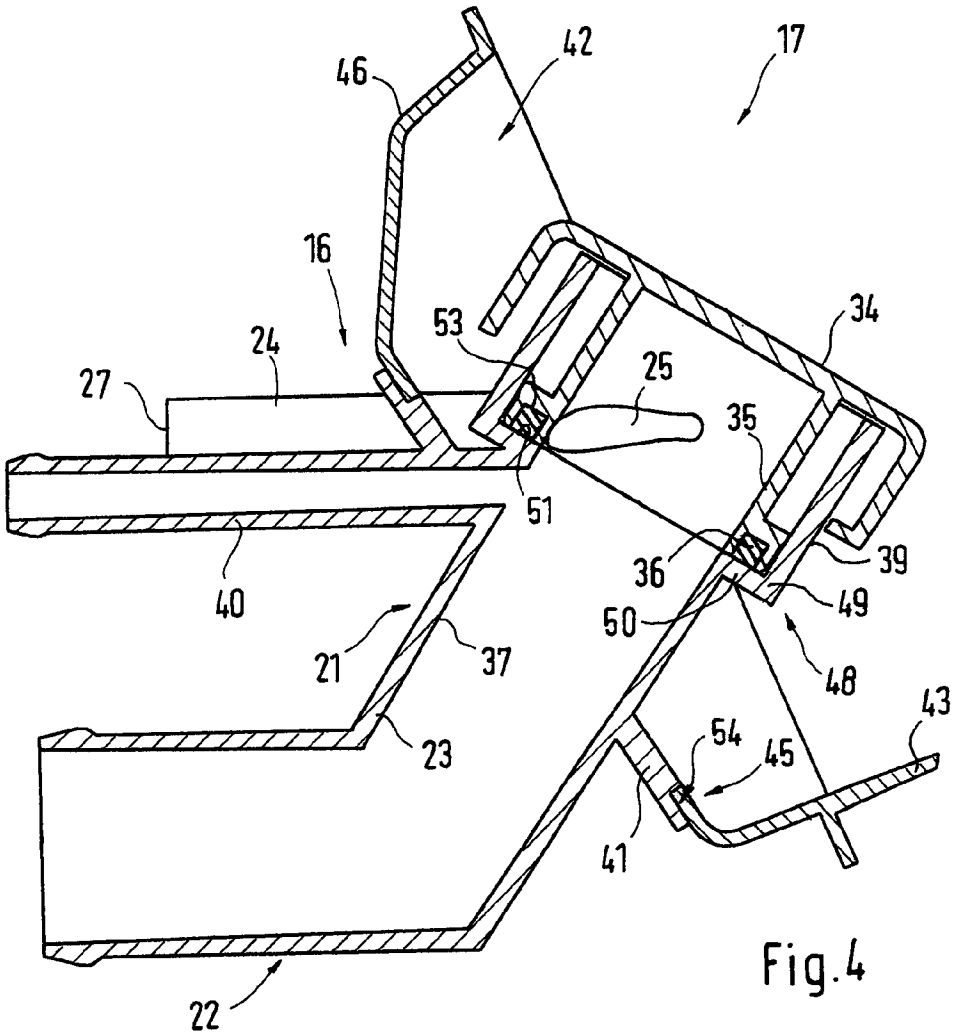
FIG. 4 is a sectional view of a filling connection with a closing cap and an overflow connection according to a second embodiment of a service unit according to the present invention.

According to another embodiment of a service unit 17 according to FIG. 4, the filling connection is equipped with a widened area 48 which has a larger inside diameter of the pipe 23 in comparison with the remainder of the filling section 21. The widened area 48 surrounds the filling opening 20 and carries the closing cap 34. The widened area 48 is formed by a step 49 which widens the inside diameter of the pipe 23 and forms a step bottom 50 in the filling section 20. The step bottom 50 functions as a sealing face 51 which cooperates with the face which is on a fork-like end turn 52 of the extension 35 of the closing cap 34 and thus forms the cutoff for the overflow connection 24. A ring groove 53 is provided on the end turn 52 to accommodate the gasket 36. Above the step bottom 50, i.e., adjacent to the filling opening 20, is the inlet opening 25 which may have an approximately oval cross section if the overflow connection 24 is attached tangentially to the pipe 23.

The filling connection 16, the overflow connection 24 and, if necessary, the connecting connection 40 may be configured or made in one piece together with the collar 41. The drip pan 42 is made as a separate part and is connected to the collar 41 at a joint 54, e.g., by gluing or welding. As already explained in conjunction with FIG. 3, the drip pan 42 is inserted into the trim panel part 47 and at least the overflow connection 24 passes through the wall 4'. Otherwise the parts shown in FIG. 4 that are the same or have the same effect are labeled with the same reference notation as those in FIG. 1 through FIG. 3. In the illustrated embodiments, the filling connection 16 with its connection 24, 40, 44 which lead away therefrom and the drip pan 42 can all advantageously be made of plastic.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

The invention claimed is:

1. Motor vehicle with a chassis, an engine, a coolant system for cooling the engine and with a filling connection for the coolant system, the filling connection being equipped with a filling opening, a removable closing cap for the filling opening and an overflow connection with an outlet opening at one end, with the overflow connection being openable when the closing cap is removed, wherein the filling opening of the filling connection is situated on a first side of a body wall of the chassis, and the overflow connection with its outlet opening opens on another side of the body wall opposite the first side into a region external to the coolant system.

2. Motor vehicle as claimed in claim 1, wherein the filling connection is arranged to pass through the wall.

3. Motor vehicle as claimed in claim 1, wherein the overflow connection extends from the filling connection close to the filling opening and passes through the wall.

4. Motor vehicle as claimed in claim 1, wherein the closing cap has an internal extension which protrudes into the filling connection and forms a cutoff for the overflow connection spaced from the filling opening.

5. Motor vehicle as claimed in claim 1, wherein the overflow connection extends laterally from the filling connection and has an inlet opening in a pipe wall of the filling connection.

6. Motor vehicle as claimed in claim 3, wherein the overflow connection extends laterally from the filling connection and has an inlet opening in a pipe wall of the filling connection.

7. Motor vehicle as claimed in claim 6, wherein the closing cap has an internal extension which protrudes into the filling connection and forms a cutoff for the overflow connection spaced from the filling opening.

8. Motor vehicle as claimed in claim 4, wherein the cutoff is configured to seal the inlet opening when the closing cap is placed on the filling connection and opens the inlet opening when the closing cap is removed.

9. Motor vehicle as claimed in claim 1, wherein the wall forms a partition which divides an engine compartment for the engine and another vehicle compartment.

10. Motor vehicle as claimed in claim 9, wherein the engine compartment is on the another side of the wall, and the luggage compartment is on the first side of the wall.

11. Motor vehicle with a chassis, an engine, a coolant system for cooling the engine and with a filling connection for the coolant system, the filling connection being equipped with a filling opening, a removable closing cap for the filling opening and an overflow connection with an outlet opening at one end, with the overflow connection being openable when the closing cap is removed, wherein the filling opening of the filling connection is situated on a first side of a body wall of the chassis, and the overflow connection with its outlet opening opens on another side of the body wall opposite the first side, wherein the filling connection is at least partially surrounded close to the filling opening by a collar forming a drip pan.

12. Motor vehicle as claimed in claim 11, wherein the drip pan has a drain connection opening on another side of the wall.

13. Motor vehicle as claimed in claim 12, wherein the filling connection and the drip pan are a unitary piece.

14. Motor vehicle as claimed in claim 11, wherein the filling connection and the drip pan are a unitary piece.

15. Motor vehicle as claimed in claim 11, wherein the filling connection, the overflow connection and the drip pan are a unitary piece, with the filling connection having a connecting section for the coolant system and a filling section at an angle to the connecting section, said filling section comprising the filling opening; the overflow connection leading away from the filling section and running approximately parallel to the connecting section, and the drip pan extending from the filling section and, with its peripheral wall, in the direction of the filling opening.

16. Motor vehicle as claimed in claim 11, wherein the filling connection and the drip pan are at least one of separate parts and connected to each other.

17. Motor vehicle with a chassis, an engine, a coolant system for cooling the engine and with a filling connection for the coolant system, the filling connection being equipped with a filling opening, a removable closing cap for the filling opening and an overflow connection with an outlet opening at one end, with the overflow connection being openable when the closing cap is removed, wherein the filling opening of the filling connection is situated on a first side of a body wall of the chassis, and the overflow connection with its outlet opening opens on another side of the body wall opposite the first side, wherein the wall forms a partition which divides an engine compartment for the engine and another vehicle compartment, and the engine compartment is centrally arranged in the motor vehicle and the partition divides the engine compartment from a luggage compartment.

18. Motor vehicle as claimed in claim 9, wherein the partition stands approximately upright inside the chassis.

19. Motor vehicle according to claim 18, wherein in the engine compartment is centrally arranged in the motor vehicle and the partition divides the engine compartment from a luggage compartment.

20. Motor vehicle as claimed in claim 17, wherein a passenger compartment and the luggage compartment form a vehicle interior compartment.

21. Motor vehicle as claimed in claim 20, wherein the engine compartment is on the another side of the wall, and the luggage compartment is on the first side of the wall.

* * * * *